United States Patent [19]

Horie et al.

[11] Patent Number: 4,644,961

[45] Date of Patent: Feb. 24, 1987

[54] MACHINE FOR MANUFACTURING FILTER-TIPPED CIGARETTES

[75] Inventors: Motonobu Horie; Teruo Shimizu; Kouichiro Obara, all of Tokyo, Japan

[73] Assignee: Japan Tobacco, Inc., Japan

[21] Appl. No.: 705,601

[22] Filed: Feb. 26, 1985

[30] Foreign Application Priority Data

Jul. 20, 1984 [JP] Japan ..... 59-149724

[51] Int. Cl.[4] ..... A24C 5/47

[52] U.S. Cl. ..... 131/94

[58] Field of Search ..... 131/94, 95

[56] References Cited

U.S. PATENT DOCUMENTS

| | | | |
|---|---|---|---|
| 3,363,632 | 1/1968 | Gamberini | 131/94 |
| 3,367,341 | 2/1968 | Skala | 131/94 |
| 3,473,536 | 10/1969 | Oesterling et al. | 131/94 |
| 3,506,017 | 4/1970 | Schubert | 131/94 |
| 4,003,386 | 1/1977 | Bald et al. | 131/94 |
| 4,431,010 | 2/1984 | Seragnoli | 131/94 |
| 4,492,238 | 1/1985 | Wheless | 131/95 |

*Primary Examiner*—V. Millin

*Assistant Examiner*—H. Macey

*Attorney, Agent, or Firm*—Lowe, Price, LeBlanc, Becker & Shur

[57] ABSTRACT

A device for manufacturing a filter-tipped cigarette, in which paste coupling paper is wound around a unit comprising two cigarettes laid coaxially with each other and a filter tip interposed between the cigarettes, while the unit is being rotated in a rolling passage defined between a cylindrical drum and a rolling mechanism facing the drum, so that a cigarette having the filter tip and being twice as long as a normal cigarette is made. The rolling mechanism comprises groups of rollers, an endless belt rotatable around the rollers, and a rolling block for supporting the belt to move it near the drum. The mechanism and the drum are in such relative positions that the belt can be moved without being in contact with the drum, when the unit is not supplied onto the drum.

6 Claims, 1 Drawing Figure

MACHINE FOR MANUFACTURING FILTER-TIPPED CIGARETTES

BACKGROUND OF THE INVENTION

The present invention relates to a machine for joining together a filter tip and cigarettes with pasted coupling paper to form a cigarette having a filter tip.

To manufacture a filter-tipped cigarette according to the prior art, pasted coupling paper is wound around a unit comprising two cigarettes laid coaxially with each other and a filter tip material twice the length of a filter tip interposed between the two cigarettes to conjoin the cigarettes and the filter tip material into a single rod-like article. The single rod-like material is then cut in the middle into two filter-tipped cigarettes. Conventionally, during forming, the unit is kept in a shallow groove of a cylindrical drum so that the unit is conveyed into a rolling passage. The coupling paper is then wound around the unit as the unit is taken out of the groove and rotated rearward by a rolling mechanism.

Such a method of winding and device therefor is disclosed, for example, in Japanese Patent Application Post-Examination Publication No. 50-19639. In the device, a rolling mechanism facing a cylindrical drum has a belt which is moved in the same direction of rotation as the cylindrical drum as a unit is pinched and rolled between the drum and the belt, to wind coupling paper around a filter tip material and cigarettes.

In the device employing the belt, the revolution speed of the cylindrical drum or the cigarette production speed can be increased without heightening the rolling speed of the unit. However, since the belt extends around at least one half of the circumference of the cylindrical drum, there is a problem that the belt comes into contact with the surface of the drum and is worn and the surface of the drum is damaged when the cigarette or the filter tip is not supplied.

In the British Patent Application Laid-Open to the Public No. 2078090A, in order to solve this problem, a device having a mechanism, which uses a magnetic or pneumatic force to attract the inside of a belt to support it, and another device, in which the wide belt is used and the belt is supported at both the side edges by discs, are proposed. However, with these devices, the construction is inevitably complicated to keep the belt concave. In addition, since a strong force acts to support the belt, the belt is likely to be damaged. For this reason, there is another problem that these devices are uneconomic in the maintenance of equipment.

SUMMARY OF THE INVENTION

The present invention was made in order to solve the problems mentioned above. The purpose of the present invention is to provide a device in which although a means for keeping a belt concave is not provided, the belt does not come into contact with the surface of a cylindrical drum even when no unit is in a rolling passage; and in which a substantially uniform force is applied to each unit, regardless of possible lack of a portion of the unit, to roll the unit.

In the device according to the present invention, the unit is supplied into the rolling passage defined between the cylindrical drum and the endless belt being moved near the surface of the drum at a speed lower than that of said surface, so that the unit is rotated. The endless belt is tightly laid around groups of rollers including a swingable and a driving rollers mounted on shafts parallel with the rotary shaft of the cylindrical drum. A rolling block is provided inside the endless belt in the position where the belt comes closest to the cylindrical drum. The rolling block has a cylindrical concave surface concentric with the surface of the cylindrical drum. The distance between these surfaces of the rolling block and the cylindrical drum is kept uniform, so that the belt, which moves straight when no unit is between the belt and the drum, moves in a curved form along the surface of the rolling block when the unit is between the drum and the belt. Since the belt is not curved beyond necessity, the unit is securely rolled between the drum and the belt.

Nearly constant tension is applied to the endless belt by the swingable roller so that the belt does not come into contact with the cylindrical drum even when no unit is between the belt and the drum and that the force acting to each unit does not much fluctuate even if the number of the units being rolled changes.

DETAILED DESCRIPTION OF THE EMBODIMENTS

Figure 1:
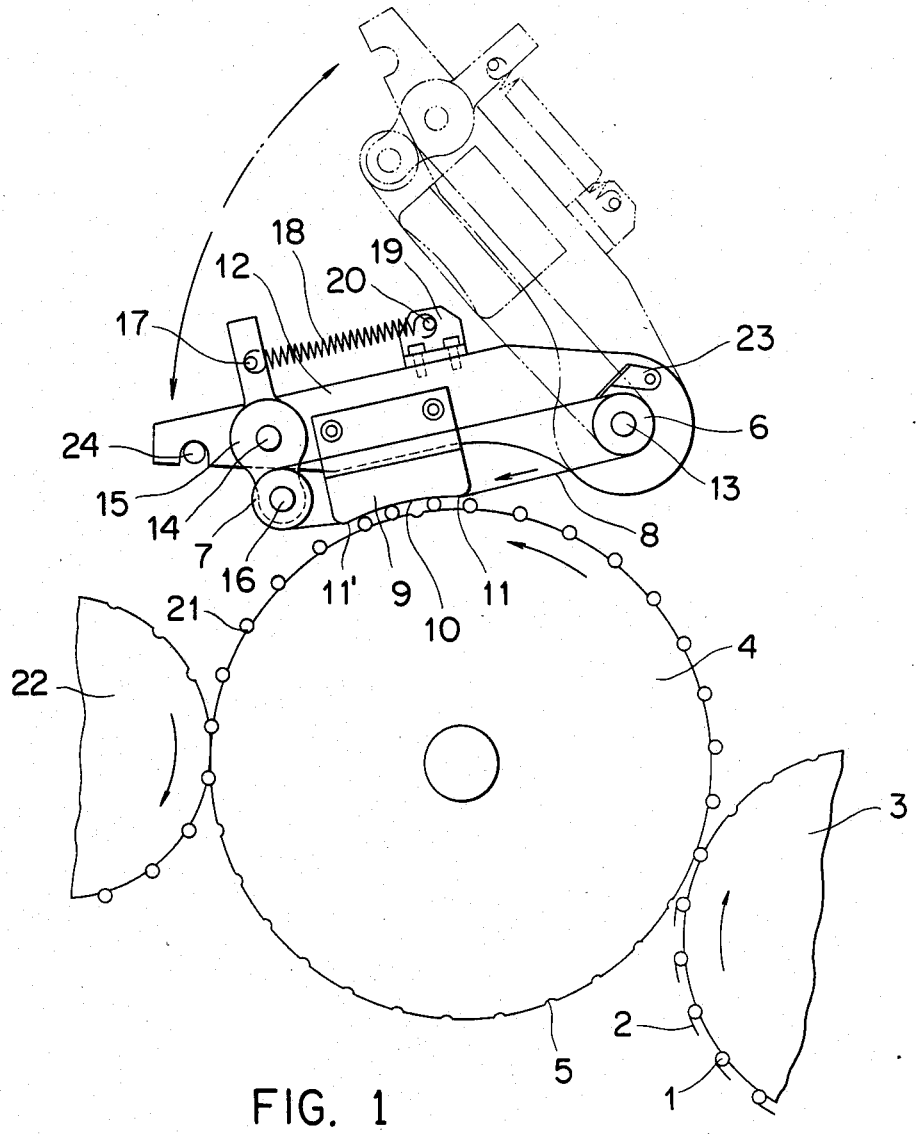
FIG. 1 indicates the operating state of a filter-tipped cigarette manufacturing device according to the present invention.

The construction and operation of a device according to the present invention are hereinafter described in detail with reference to FIG. 1.

A unit 1 comprising two cigarettes laid coaxially with each other and a filter tip material, which is interposed between the cigarettes and is twice as long as that of the final cigarette product, is held on an assembly drum 3 and a cylindrical drum 4 as the front edge of pasted coupling paper 2 remains stuck to the unit. Grooves 5 are provided at regular intervals on the surfaces of the drums 3 and 4. An air suction hole (not shown in the drawing) is provided inside each groove 5 to suck the unit 1 to hold it as the unit is conveyed. A driving roller 6 and a swingable roller 7 are rotatably mounted on shafts 13 and 16, respectively, over the cylindrical drum 4. An endless belt 8 is tightly trained around the rollers 6 and 7.

An arm 12 is attached to the shaft 13 of the driving roller 6 in such a manner that the arm can pivot. A lever 15 mounted on the shaft 16 of the swingable roller 7 is pivotally secured on a shaft 14 provided in the tip of the arm 12. A spring 18 is provided between a pin 17 in the upper portion of the lever 15 and a pin 20 in a bracket 19 secured on the arm 12 to apply tension to the endless belt 8.

A rolling block 9 is secured on the arm 12, inside the belt 8 in the position where the belt comes closest to the surface of the cylindrical drum 4. The bottom surface 10 of the rolling block 9 faces the surface of the cylindrical drum 4 across the endless belt 8. The bottom surface 10 is concave and concentric with the surface of the cylindrical drum 4. The distance between these surfaces of the rolling block 9 and the cylindrical drum 4 is such that the unit 1 and the endless belt 8 are slightly pressed when they are between said surfaces. The front end 11 and rear end 11' of the bottom surface 10 of the rolling block 9 are provided with convex facets smoothly continuous to the concave surface 10. The length from the front end 11 of the rolling block 9 to the rear end 11' needs to be so short that the belt 8 does not come into contact with the surface of the cylindrical drum 4 when no unit is between the rolling block and the cylindrical drum. Said length also needs to be larger than the interval between the grooves 5 of the cylindrical drum 4. For instance, when the diameter of the cylindrical drum 4 is 330 mm (about 40 times that of each cigarette) and thirty grooves 5 are provided on the surface of the drum, the length of the rolling block 9 should preferably be about twice the interval between the grooves 5.

To attach the filter tip to the cigarettes by using the device embodied according to the present invention, the unit 1 is first assembled on the assembly drum 3 by a conventional means and then transferred onto the cylindrical drum 4. When the unit 1 is moved in under the rolling block 9 as the unit is sucked in the groove 5, the unit is pinched between the endless belt 8 and the cylindrical drum 4 and the belt is pushed up by the unit 1. At that time, the belt 8 is moved forth as it is in close contact with the concave surface 10. Because the belt 8 is moved in the same direction as the cylindrical drum 4, at a speed which is smaller than the circumferential velocity of the drum and preferably not larger than about one-third of the circumferential velocity, and unit 1 receives a clockwise turning force while moving under the rolling block 9, so that the unit is rolled out of the groove 5. After the unit 1 performs one round of rolling, it enters the following groove 5.

The coupling paper 2 is thus wound around the cigarettes and the filter tip so that a cigarette 21 having the filter tip and being twice as long as a cigarette as a final product is made. It is desirable that as soon as the cigarette 21 is made and moved out from under the rolling block 9, the cigarette enters the groove 5 again. Such timing can easily be attained by adjusting the moving speed of the endless belt 8.

The completed cigarette 21 is conveyed as it remains sucked in the groove 5 on the cylindrical drum 4. The cigarette 21 is then transferred onto a takeout drum 22 and cut off in the middle so that two filter-tipped cigarettes are manufactured.

Since the belt 8 is contaminated with paste, coupling paper, etc. during the winding of the unit, a scraper 23 is installed near the driving roller 6 to incessantly remove the contamination from the surface of the belt 8 to keep it clean.

The arm 12 can be turned about the shaft 13 as a fulcrum to facilitate the replacement of the belt 8, the checking of the rolling block 9, etc. The arm 12 is placed in the normal position by a pin 24. The arm 12 is secured by a fixation means (not shown in the drawing) so that the arm cannot move in operation.

The endless belt 8 is made of a flexible material such as a thin metal sheet and a fiberglass-reinforced plastic sheet so that the belt can be easily deformed according to the convex and concave surfaces of the rolling block 9.

Because the device embodied according to the present invention is constructed as described above, winding pressure does not concentrate on units before and after an empty groove which has no unit due to the intermittent supply of the units. In addition, the endless belt is kept from becoming worn or damaged due to coming into contact with the cylindrical drum, the rolling mechanism is compact and its maintenance and control are easy.

What is claimed is:

1. In a machine including a cylindrical drum and a rolling mechanism for manufacturing a filter-tipped cigarette in which pasted coupling paper is wound around a unit defined by a pair of untipped cigarette portions spaced coaxially with each other on the drum and a filter tip material is interposed between the untipped cigarettes and attached to the cigarettes with the paper while the unit rotates in a rolling passage defined between said cylindrical drum carrying the unit and the rolling mechanism facing the drum, the improvement wherein said rolling mechanism comprises a pair of rollers rotatably and respectively mounted on shafts supported in the machine in generally parallel relation to a rotary shaft supporting the cylindrical drum; an endless belt mounted to rotate around said rollers in opposing relation to a surface of the drum; and a belt positioning block mounted between said rollers between an upper and lower extent of said belt, said positioning block having a cylindrical concave surface positioned concentric with the surface of said cylindrical drum, said belt extending between said concave surface and the cylindrical drum surface, wherein the length of said concave surface as measured between opposite ends thereof in the circumferential direction of said cylindrical drum surface and the radial positioning of said concave surface relative to the rotary shaft of said drum is such that in an operating position of said rolling mechanism, during running of said machine, said belt is supported by said ends to normally extend in a generally straight line therebetween in spaced relation to said concave surface and said cylindrical drum surface and out of wearing contact therewith, said belt being positioned to deform into engagement with the concave surface under the action of said unit advancing into contact with the belt during rotation of said drum, a portion of said belt extending between said ends thereby defining the rolling passage with the cylindrical drum surface.

2. The machine of claim 1, further comprising means for driving said belt in the same direction as the drum and at a circumferential velocity approximately one-third or less than the velocity of said drum.

3. The machine of claim 1, wherein said rolling mechanism includes an arm pivotally mounted at one end thereof to the machine by means of the shaft carrying one of said rollers, and means for pivotally mounting the other of said rollers to said arm, and means associated with the second mounting means for imparting tension to the belt, said positioning block being mounted to said arm between the pair of rollers.

4. The machine of claim 1, wherein said ends of the positioning block are smoothly convex and continuous with the concave surface extending therebetween.

5. The machine of claim 4, wherein said ends of the positioning block are spaced from the rollers.

6. The machine of claim 1, wherein said cylindrical drum includes a plurality of transverse grooves spaced from each other and formed in the periphery of said drum surface, said concave surface of the positioning block extending coextensively to overlap at least two adjacent grooves.

* * * * *